United States Patent [19]

McGee

[11] Patent Number: 4,615,548

[45] Date of Patent: Oct. 7, 1986

[54] DOOR LOCK SYSTEM

[76] Inventor: Michael H. McGee, 4620 Alla Rd., Los Angeles, Calif. 90066

[21] Appl. No.: 810,658

[22] Filed: Dec. 17, 1985

Related U.S. Application Data

[63] Continuation-in-part of Ser. No. 587,358, Mar. 8, 1984.

[51] Int. Cl.[4] ..... E05C 1/06

[52] U.S. Cl. ..... 292/144; 70/279; 292/148

[58] Field of Search ..... 292/67, 68, 144, 145, 292/148, 162; 70/279

[56] References Cited

U.S. PATENT DOCUMENTS

| | | | |
|---|---|---|---|
| 608,321 | 8/1898 | Carleton | 292/144 |
| 635,352 | 10/1899 | Sawtelle | 292/67 X |
| 2,794,663 | 6/1957 | Grodt et al. | 292/67 |
| 2,815,796 | 12/1957 | Lobanoff | 292/144 X |
| 3,166,144 | 1/1965 | Price | 292/144 |
| 4,021,063 | 5/1977 | Porter | 292/67 |
| 4,254,582 | 3/1981 | McGee | 292/144 X |
| 4,277,094 | 7/1981 | Roue | 292/144 X |
| 4,372,419 | 2/1983 | Barnett et al. | 292/144 X |

*Primary Examiner*—Gary L. Smith
*Assistant Examiner*—Russell W. Illich
*Attorney, Agent, or Firm*—Freilich, Hornbaker, Rosen & Fernandez

[57] ABSTRACT

A door lock system is described of the type wherein the solenoid that includes a plunger retractable from a latch hole, can be manually slid away from the latch hole. The solenoid coil is mounted on a slideable bracket by leaf springs with bent ends, that permit the coil to pivot when the plunger is forced against a side of the latch hole.

8 Claims, 4 Drawing Figures

DOOR LOCK SYSTEM

CROSS REFERENCE TO RELATED APPLICATION

This is a continuation-in-part of U.S. application Ser. No. 587,358 filed Mar. 8, 1984.

BACKGROUND OF THE INVENTION

One type of system for locking a closed overhead garage door, includes a latch mounted on the garage door and a solenoid mounted on the door frame and having a plunger that passes through a hole in the latch. A system of this type is described in U.S. Pat. No. 4,254,582 by McGee, for Electrically Actuated Overhead Garage Door Opener Assembly. A clearance must be left between the side of a garage door and the door frame, and vandals may try to open or break the lock by tools inserted through the clearance space. One technique used by vandals is to insert a bolt or other member so its end lies against the plunger, and then hit the bolt with a hammer, in order to break the solenoid loose from its mounting. There is a danger that the solenoid will break free, because it must be held sufficiently rigid so the plunger is maintained in alignment with holes in the lock box and latch for normal operation. A load in the opposite direction can occur if the garage door closes when the plunger is extended.

Another problem that must be overcome with such latching systems is to provide for manual opening of the lock in the event of a power failure that prevents energizing of the solenoid to withdraw the plunger. Any arrangement which permits an authorized user to withdraw the plunger in the event of a power failure, should not make the lock vulnerable to withdrawal of the plunger by a vandal. A garage lock system which resisted tampering by vandals or damage from inadvertent door closing, while assuring secure locking and unlocking under normal conditions, and while permitting authorized users to unlock the lock in the event of a power failure, would be of considerable value.

SUMMARY OF THE INVENTION

In accordance with one embodiment of the present invention, a low cost and reliable door lock system is provided of a type which resists damage by vandals or accidental closing while permitting manual opening. This type of system includes a solenoid whose coil can be manually moved in an inward, longitudinal direction, to withdraw the plunger of the solenoid and allow opening of the door when the coil is not energized. The coil is mounted on a longitudinally moveable bracket, by spring means that permits the coil to tilt with respect to the bracket. The spring means can include one or more leaf springs that bias the coil and bracket apart at at least two locations that are longitudinally spaced. A pair of longitudinally spaced fasteners limit the separation of the coil and bracket to set the initial orientation of the coil and plunger.

The novel features of the invention are set forth with particularity in the appended claims. The invention will be best understood from the following description when read in conjunction with the accompanying drawings.

DESCRIPTION OF THE PREFERRED EMBODIMENT

Figure 1:
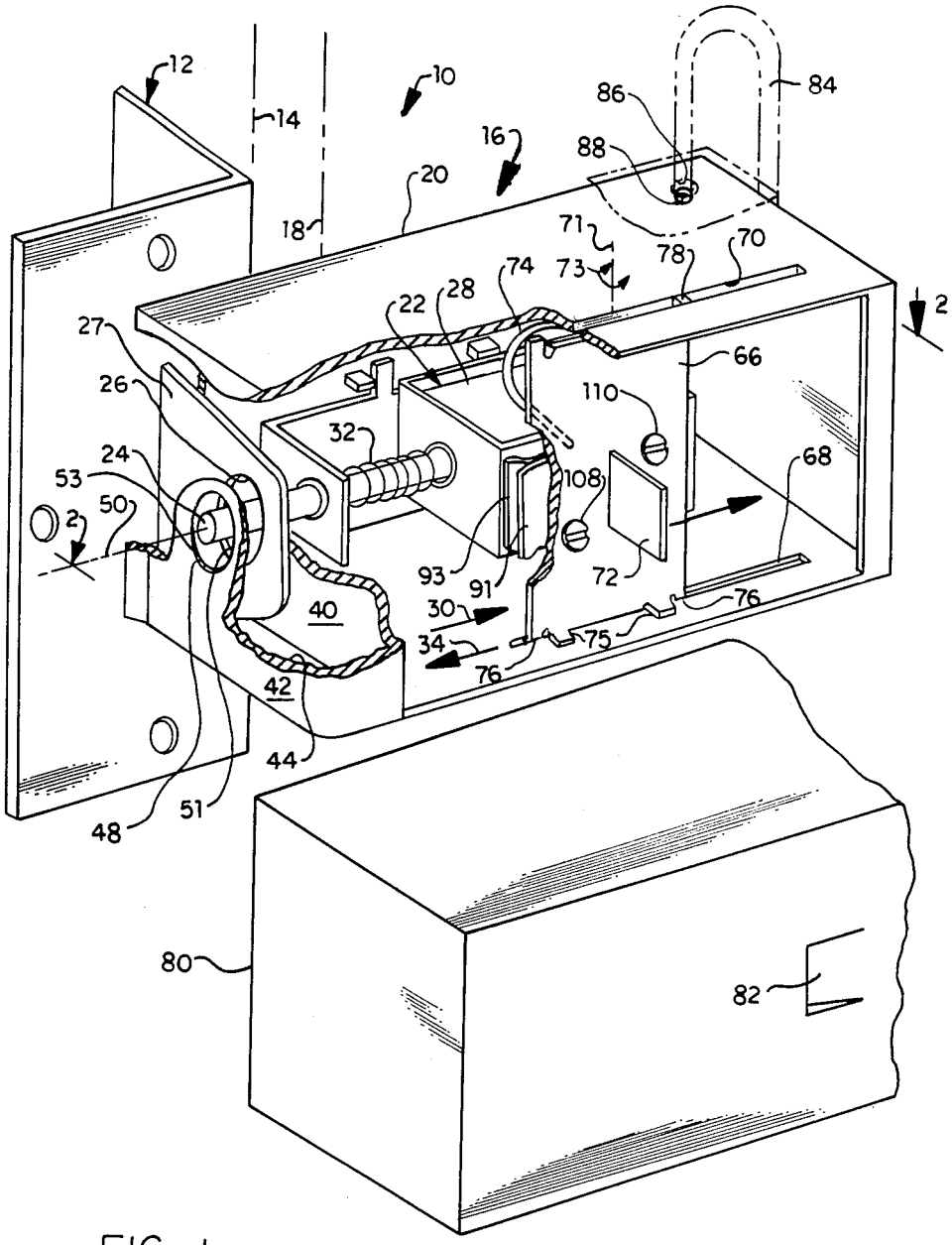
FIG. 1 is a partially sectional perspective view of a garage door lock system constructed in accordance with the present invention, with the cover shown removed from the lock box.

FIG. 1 illustrates a door lock system 10 for a garage, which includes a latch device 12 mounted on a garage door 14 and a lock assembly 16 mounted on a door frame 18. The lock assembly includes a housing in the form of a lock box 20 that carries a solenoid 22. The pin or plunger 24 of the solenoid can pass through a plunger-receiving hole 26 in a plate-like latch 27 of the latch device, to hold the door closed. When a coil 28 of the solenoid is energized, the elongated plunger 24 is moved in an inward longitudinal direction indicated by arrow 30, against the force of a spring 32, so the plunger withdraws from the latch hole 26 to permit opening of the door. When the coil is de-energized, the spring 32 urges the plunger in the outward longitudinal direction indicated by arrow 34, so the plunger can pass through the latch hole.

Figure 2:
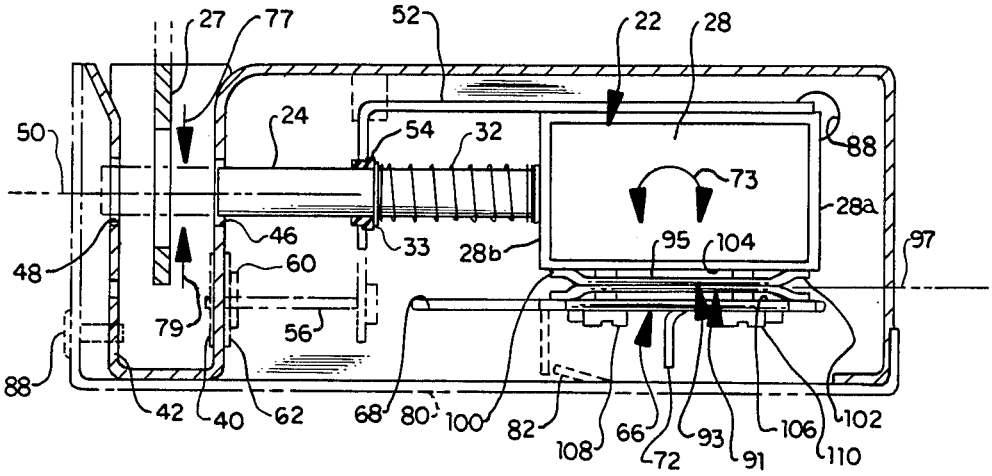
FIG. 2 is a sectional view taken on line 2—2 of FIG. 1.

The lock box 20 is constructed of heavy gage steel to securely hold the plunger 24 in position despite tampering by vandals. The lock box includes a pair of spaced locking plates 40, 42 which form an opening 44 between them through which the latch 28 can be received. It is possible to use only one plate although this decreases strength. As shown in FIG. 2, each of the plates has walls forming a plunger-receiving hole 46, 48 through which the plunger can pass. The solenoid and plunger-receiving holes 46, 48 are positioned so that the axis 50 of the plunger is aligned with the holes in the initial position of the plunger (when it is not pressed to one side by vandals), so the plunger then does not make contact with the walls of either hole 46, 48. The holes 46, 48 are, of course, sufficiently wider than the plunger to leave clearance around the plunger.

In the event of a power failure, the garage door can be opened and closed by manually moving the coil 28 in the inward direction 30. The coil or coil device 28 of the solenoid 22 is mounted on a bracket 66 which can slide along a pair of slots 68, 70 that are formed in the lock box and that extend parallel to the axis 50 of the plunger. The bracket includes a handle 72 for moving the solenoid longitudinally against the force of an over-center spring 74 that retains the solenoid in the inward or outward position to which it has been moved. A stop 82 on a cover 80 can retain the solenoid in its outward position.

The bracket 66 includes two pairs of legs 76, 78 which lie within each slot 68, 70. Each pair of legs such as 76 is longitudinally spaced far enough to avoid more than negligible pivoting of the bracket about a vertical axis 71, as indicated by arrows 73, to urge the plunger away from opposite sides 51, 53 of each hole such as 48. A pair of feet 75 tend to keep the bracket upright.

If the wind should blow the garage door shut while the plunger is extended, then the latch 27 on the door will hit the plunger in the direction of arrow 77. On the other hand, if the burglar tries to pull open the door, then the latch 27 will hit the plunger in the direction of arrow 79. The solenoid coil 28 must be mounted so that it can pivot in the direction 73 to allow the plunger to hit opposite sides of a plate hole. Applicant provides a relatively simple arrangement for enabling such pivoting of the plunger, by coupling the solenoid coil 28 to the bracket 66 through a pair of leaf springs 91, 93.

Each leaf spring 91, 93 has a flat middle portion 95 lying in a plane 97, and a pair of ends 100, 102 that are bent out of the plane 97, with both ends of the same spring bent to the same side of the plane. The flat middle portions of the leaf springs lie facewise against one another (a thin sheet can be placed between them). The opposite ends of one leaf spring 93 abut a surface 104 of the coil. The opposite ends of the other leaf spring 91 abut a surface 106 of the bracket that faces the coil and which lies in a plane largely parallel to the facing plane of the coil. A pair of screws or other fasteners 108, 110 pass through holes in the two leaf springs, and initially hold the two leaf springs in compression: that is, without the fasteners, the facing surfaces of the coil and the bracket would be further spaced apart. If the plunger 24 is forced in the direction 77, then one end 100 of both leaf springs will be compressed, while the opposite ends 102 will expand away from each other. In a similar manner, if the plunger is pushed in the direction 79, then the ends 100 will separate more and the opposite ends 102 will be pushed closer together.

Figure 3:
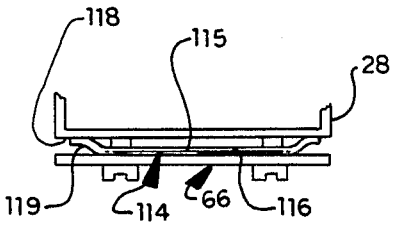
FIG. 3 is a partial view of another embodiment of the invention.

FIG. 3 illustrates another embodiment of the invention, wherein a single leaf spring 114 is used to couple the bracket 66 to the coil 28. The bracket has a flat surface portion 116 that engages the flat middle portion 115 of the leaf spring. The coil has a pair of surface portions 118 that engage the bent end portions 119 of the leaf spring.

Figure 4:
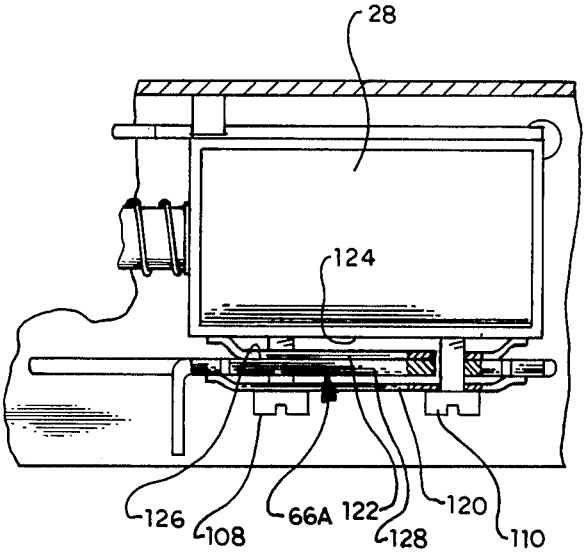
FIG. 4 is a partial view of another embodiment of the invention.

FIG. 4 illustrates another embodiment of the invention, wherein two leaf springs 120, 122 are used in an arrangement wherein one spring 122 lies between the surfaces 124, 126 of the coil and bracket 28, 66A, while the other leaf spring 120 lies between an outer surface 128 of the bracket and the heads of screw fasteners 108, 110.

Thus, the invention provides a door lock system with a solenoid coil which can move longitudinally to enable manual withdrawal of the plunger if there is no power, and yet which provides a simple means for enabling pivoting of the coil and plunger while urging them towards an initial orientation wherein the plunger is away from the holes in the plates and latches. This is accomplished by the use of spring means resiliently mounting the coil or coil device on the bracket to hold the coil in a substantially constant location with respect to the bracket while permitting the coil to tilt by a limited angle. The spring can be one or more leaf springs in any of several different arrangements.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A door lock system for locking a door to a door frame, comprising:

a latch device which is mountable on a door and which has a plate-like latch with a latch hole;

a lock box which can be fastened to said door frame, said box having at least one plate with walls forming a plunger-receiving hole that can lie adjacent to the latch hole when the door is closed, said plunger-receiving hole being wider than said plunger so that when the latch lies beside the plate, a plunger can pass through the plunger-receiving hole and the hole in the latch;

a solenoid which includes an energizeable coil device, and which also includes a plunger extending along a plunger axis in a predetermined outward direction from said coil device and through said latch hole and plunger-receiving hole when the coil is unenergized; and means mounting said coil device to bias it toward an orientation at which said plunger is away from contact with the walls of said plunger-receiving hole, but permitting said plunger to be moved against the plunger-receiving hole, said mounting means also supporting said coil device in movement substantially parallel to said plunger axis so the coil device can be moved in a predetermined inward direction to withdraw the plunger from the latch hole without energized the coil device;

said mounting means comprising a bracket which is slideably mounted on said lock box to resist pivoting about a second axis perpendicular to said plunger axis while permitting the bracket to move in said outward and inward directions, and spring means for resiliently mounting the coil device on said bracket to hold said coil device in a substantially constant location with respect to the bracket while permitting the coil device to tilt by a limited angle with respect to the bracket to permit the plunger to press against the walls of the plunger receiving hole.

2. Th system described in claim 1 wherein:

said coil device and said bracket each have inner and outer locations spaced from each other, said outer locations being closer to said plate of said box than said inner location, and said mounting means includes fastener means holding the coil device to the bracket and limiting their separation at each fastener means, while allowing said inner and outer locations on said coil device and bracket to separately move closer and away from each other, said mounting means also including means for biasing each of a pair of positions on said coil device and bracket away from each other, whereby to urge the coil device toward a predetermined orientation while allowing it to pivot.

3. The system described in claim 1 wherein:

said spring means includes a leaf spring having a flat middle portion lying in a predetermined plane, and having a pair of end portions bent out of said plane with both end portions bent beyond the same side of said plane;

said bracket and coil device have surfaces that are spaced from each other but face each other, one of said surfaces forming a flat surface portion that engages said flat middle portion of said leaf spring, and the other of said surfaces forming a pair of surface portions spaces primarily parallel to the plunger axis and engaging said bent end portions of said leaf spring.

4. The system described in claim 1 wherein:

said spring means includes a pair of leaf springs, each having a flat middle portin lying in a particular plane, and having a pair of end portions bent out of said plane with both end portions bent beyond the same side of the plane;

said bracket and coil device each have a pair of surface portions that are spaced from each other and face each other;

said flat middle portions of said leaf springs lying against each other, the bent ends of one leaf spring engage the pair of surfaces of the coil device, and the bent ends of the other leaf spring engage the pair of surface portions of the bracket.

5. The system described in claim 1 wherein:

said spring means includes a pair of leaf springs, each having a flat middle portion lying in a particular plane, and having a pair of end portions bent out of said plane with both end portions bent beyond the same side of the plane;

said bracket and coil device each have a pair of surface portions that are spaced from each other and face each other;

a first of said springs lies between said surface portions with its flat middle portion lying against one of said surface portions and its bent ends engaging the other surface portions, and its bent ends engaging the other surface portion, and the second spring lies on a side of said bracket opposite said coil device with its bent ends lying against the bracket; and at least one fastener extending through said bracket and both spring middle portions and is attached to said coil device.

6. In a door lock system which includes a solenoid with a plunger that can pass through holes in a latch device on a door and in a plate on a lock box, the solenoid including a coil device which can be energized to withdraw the plunger, in a inward longitudinal direction, out of the latch device hole, and a bracket that supports the coil device and that is slideably mounted on the lock box to move in the logitudinal direction to withdraw the plunger when the coil device is not energized, the improvement of means for resiliently urging the coil device toward an initial orientation where the plunger is away from the plate hole walls when it extends through the plate hole, so the plunger can be forcefully deflected against the plate hole walls but returns to the initial orientation when the deflecting force is removed, comprising:

fastener means including a pair of fastener portions spaced from one another with one closer to the plate hole than the other, each fastener portion coupled to said bracket and coil device and limiting their separation but not their closeness at the particular fastener portion location;

at least one leaf spring having a flat middle portion and a pair of longitudinally-spaced ends both bent to one side out of the plane of the middle portion, said bracket and coil device each being an element and the middle portion of the leaf spring coupled to a first or said elements at at least two longitudinally-spaced locations, and the ends of the leaf spring bearing against the second of said elements.

7. The improvement described in claim 6 including:

a second leaf spring coupling the middle portion of said first named leaf spring to said second element, said second leaf spring being of similar shape to said first leaf spring with a flat middle portion and bent ends, the middle portion of said second spring bearing against a surface of the middle of said first leaf spring, and the ends of said second leaf spring bearing against the first of said elements.

8. The improvement described in claim 6 including:

a second leaf spring being of similar shape as said first leaf spring, and lying on a side of said bracket opposite said coil device with its ends bearing against said bracket.

* * * * *